US007665711B1

(12) United States Patent
Marchionda

(10) Patent No.: US 7,665,711 B1
(45) Date of Patent: Feb. 23, 2010

(54) ICE CUBE EXTRACTION TRAY

(76) Inventor: Anthony Marchionda, 708 5th St., Struthers, OH (US) 44471

( * ) Notice: Subject to any disclaimer, the term of this patent is extended or adjusted under 35 U.S.C. 154(b) by 222 days.

(21) Appl. No.: 12/005,848

(22) Filed: Dec. 28, 2007

Related U.S. Application Data

(63) Continuation-in-part of application No. 29/265,315, filed on Aug. 30, 2006, now Pat. No. Des. 560,695.

(51) Int. Cl.
*A21B 5/00* (2006.01)

(52) U.S. Cl. ..... 249/119; 249/126; 249/154; 426/512

(58) Field of Classification Search ..... 249/119–120, 249/126, 154; 426/512
See application file for complete search history.

(56) References Cited

U.S. PATENT DOCUMENTS 3,483,908 A * 12/1969 Donovan ..... 249/127
3,825,219 A 7/1974 Cummings
4,222,547 A 9/1980 Lalonde
D292,802 S 11/1987 Fails
D397,700 S 9/1998 Rodgers
D433,691 S 11/2000 Cauley et al.
D496,374 S * 9/2004 Zimmerman ..... D15/90
6,793,193 B2 * 9/2004 de Groote ..... 249/119

* cited by examiner

*Primary Examiner*—Yogendra Gupta
*Assistant Examiner*—Thu Khanh T Nguyen
(74) *Attorney, Agent, or Firm*—Harpman & Harpman

(57) ABSTRACT

An ice cube stacking tray having a cube retaining contour in its bottom surface that allows one-handed engagement of a cube to be positioned in a self-supporting upstanding position for easy one-hand retrieval. The tray has end extension flange recessed tri-lateral areas for receiving co-depending surface of vertically engaged corresponding tray.

7 Claims, 5 Drawing Sheets

ICE CUBE EXTRACTION TRAY

This is a continuation in part of allowed patent application of Ser. No. 29/265,315 filed Aug. 30, 2006 now U.S. Pat. No. D560,695.

BACKGROUND OF THE INVENTION

1. Technical Field

This device is directed to ice cube trays that are used to freeze small quantities of water into independent ice cubes.

2. Description of Prior Art

Prior art devices of this type have been developed for forming different shaped ice cubes by use of ornamentally designed ice trays, see for example U.S. Pat. Nos. D292,802, D397,700, D433,691, 3,825,219, and 4,222,547.

In Design Patents ending in 802, 700 and 691 a variety of different ice cube trays are designed to make different integral shapes such as cars and the like.

U.S. Pat. No. 3,120,112 discloses an ice mold having a dual cube configuration in which a single enlarged ice cube is formed having two interconnected contours separated by raised ridge therebetween.

U.S. Pat. No. 3,825,219 describes an ice cube tray having multiple parallel divider walls with pivotal cross-wise dividers. Levers move the dividers with slidable rollers and springs and plunger assembly to extract the cubes.

U.S. Pat. No. 4,222,547 shows an ice tray with shaped cavities that allows the user to push down on one end of the formed ice cube rotating the cube upwardly so that it can be lifted out while the user holds the cube in elevated position.

SUMMARY OF THE INVENTION

An ice cube forming tray in which multiple oblong shaped ice cubes are formed. The tray has a remove and positioning flange area that will engage and hold the ice cube by its edge as it is rotated upwardly within the tray compartment by the user and hold the cube hands free.

The cube can then be retrieved by the user with one hand lifting it up out of the tray for select removal of just a cube at a time. The tray has an extended recessed flange end that allows the trays to be stacked during use.

DETAILED DESCRIPTION OF THE INVENTION

Referring to FIGS. 1-4 of the drawings, a stacking ice cube tray 10 of the invention can be seen having a main body member 11 with a plurality of ice cube forming mold cavities 12 formed within. The tray is made of flexible synthetic resin material and is typically filled with a liquid such as water W and then placed in a freezer (not shown) forming a plurality of identical contoured shaped ice cubes 13.

Figure 1:
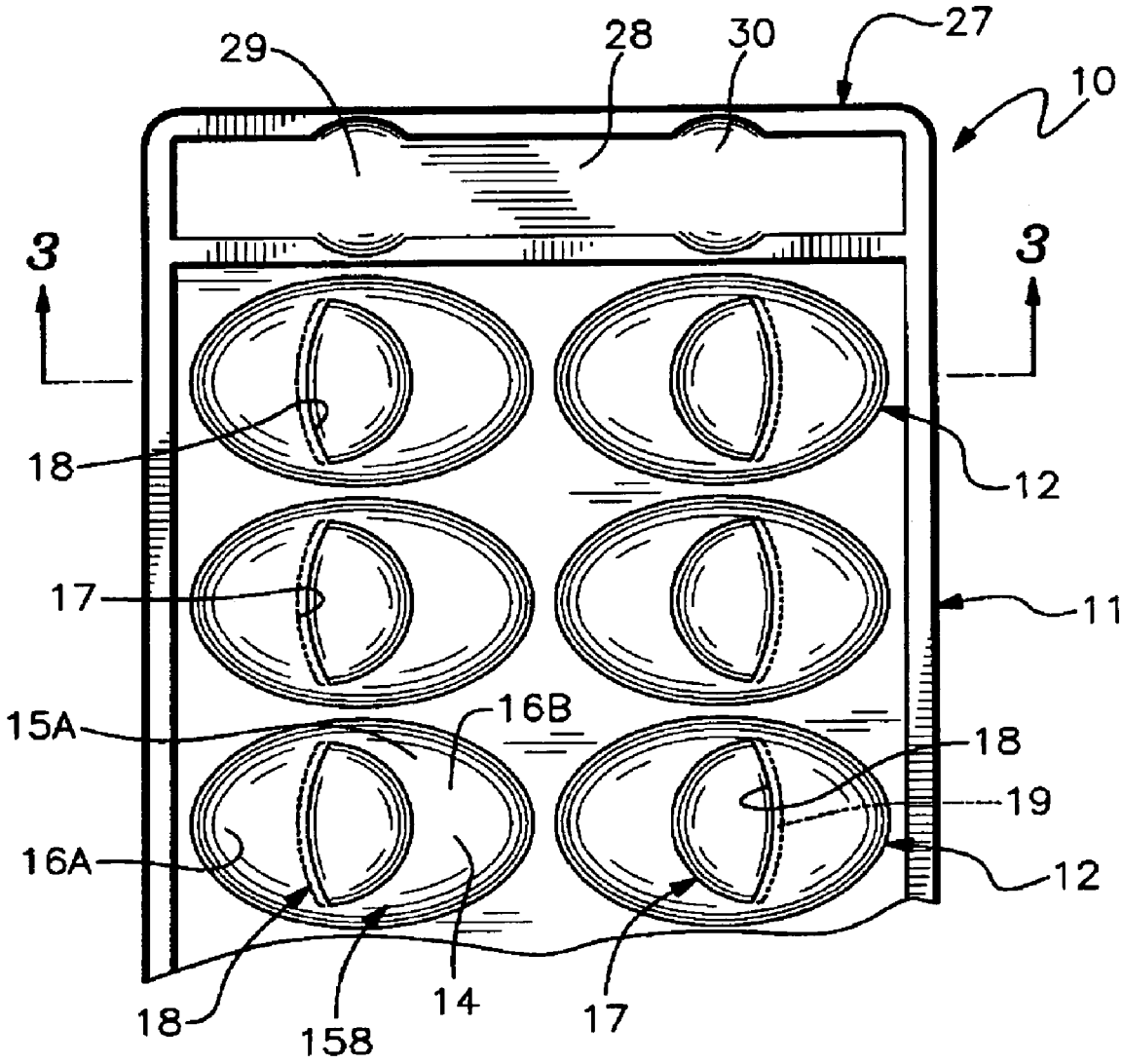
FIG. 1 is an enlarged partial top plan view of the ice cube tray showing the retaining flange area within and stacking flange extension area on one end thereof.

Each of the cube mold cavities 12 is of an oblong ovaloid shape having an inner smooth bottom surface 14 with integrally extending connective contoured smooth sides, and end surface 15A and 15B and 16A and 16B respectively. An elliptical recess area 17 is formed within the bottom surface 14 extending transversely there across between the respective oppositely disposed sides 15A and 15B as best seen in FIG. 1 of the drawings. An arcuate return flange portion 18 is defined by recess areas 17 having a tapered vertical surface at 19 therein. The vertical surface 19 defines an edge of the elliptical recess area 17 which extends within as a contoured surface into the corresponding sides 15A and 15B and end surface 16A in spaced relation thereto.

Figure 5:
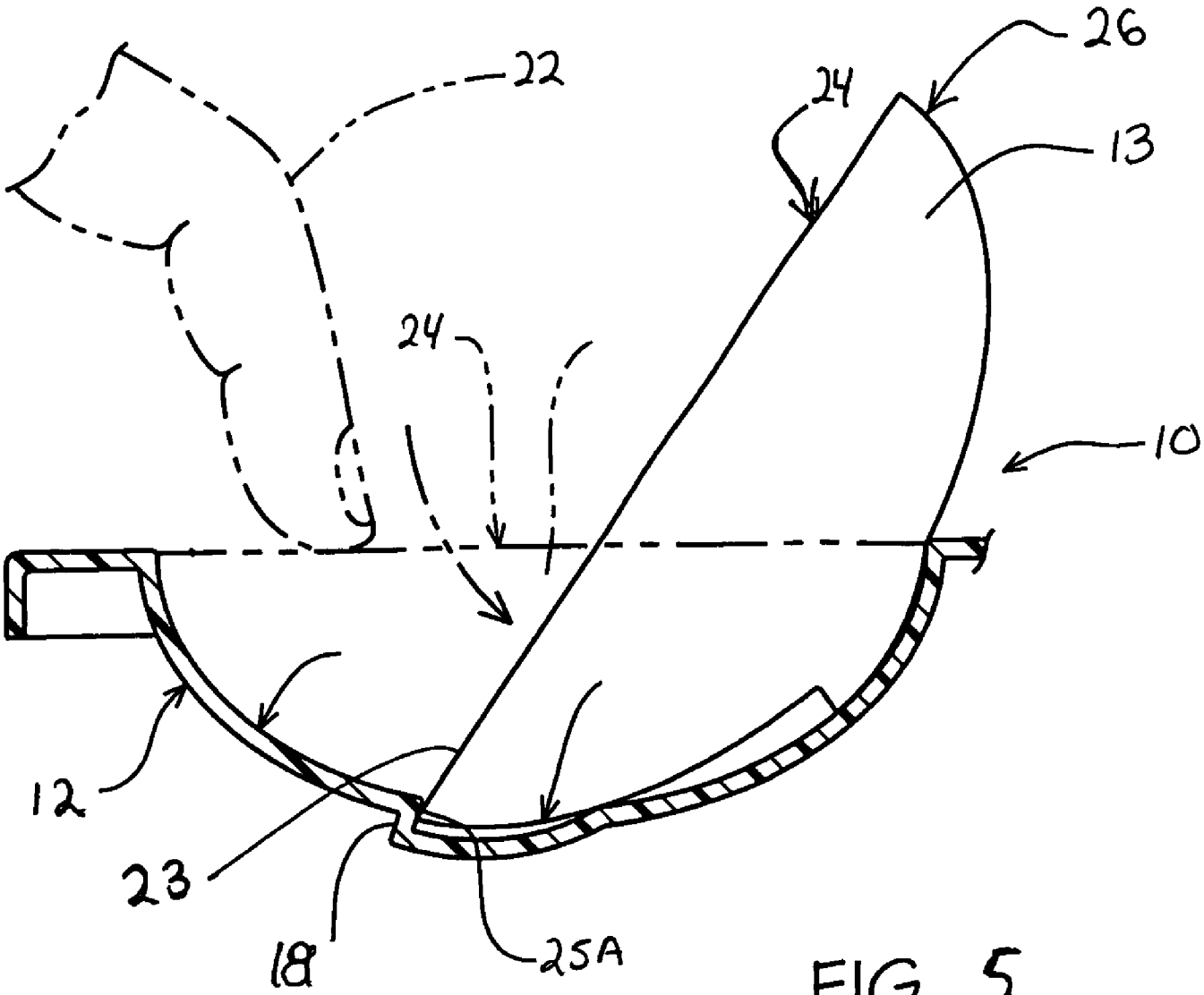
FIG. 5 is an enlarged partial cross-sectional view of a single cube mold illustrating cube repositioning for removal.

The vertical surface 19 of the return flange portion 18 provides for cube edge engagement therewith when the ice cube 13 so formed within the mold cavities 12 is repositioned therein by applied force of the user's fingers 22 as best seen in FIG. 5 of the drawings in broken lines.

In use, water W or other freezable, consumable liquids fill the multiple ice cube molds 12 of the tray 10 and is frozen by placement within the freezer (not shown). Once the frozen cubes 13 are formed as noted in solid lines in FIG. 5 of the drawings, the user can push down on one end 23 on the top surface 24 of the cube 13 sliding the cube within its mold 12 longitudinally so as to extend partially out of the mold cavities 12. The ice cube 13 engages the flange 18 and held there by the cube's leading transverse edge 25A thus positioning the cube 13 and holding it freely in the elevated position as shown in solid lines. The user can then using the same hand easily grip the cube 13 and remove it individually from the tray 10 without disturbing the remaining cubes 13 within. The tray 10 can then be returned to the freezer (not shown) and retrieved for later individual cube 13 extraction and use or multiple cubes can be extracted one at a time if so desired.

Figure 6:
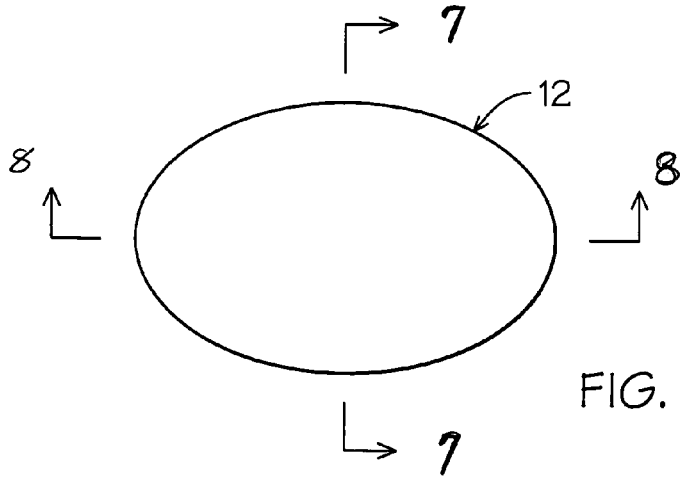
FIG. 6 is a graphic representation of an ovaloid cube tray shape.
Figure 7:
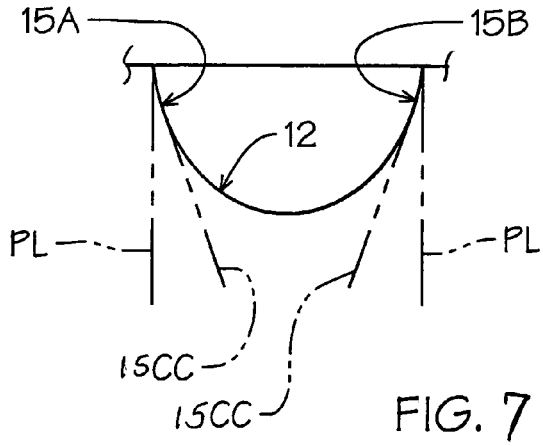
FIG. 7 is a graphic section illustration on lines 7-7 of FIG. 6.
Figure 8:
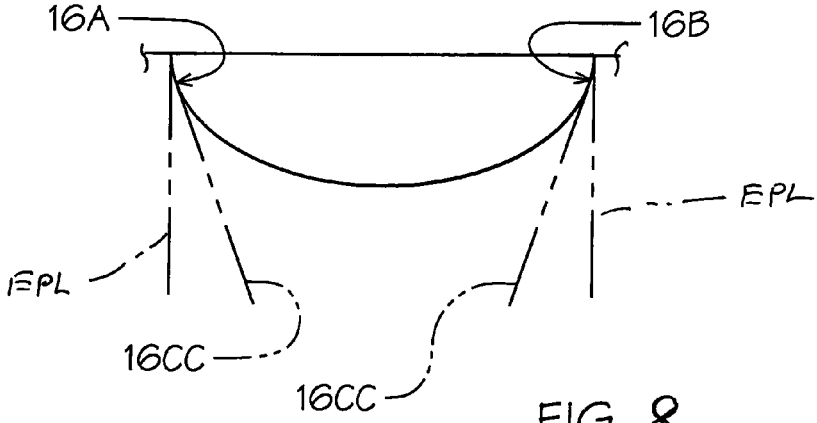
FIG. 8 is a graphic section illustration on lines 8-8 of FIG. 6.

Referring now to FIGS. 6, 7 and 8 of the drawings, a graphic representation of physical dynamics of the uniquely shaped cube mold cavities 12 of the invention is illustrated. Referring first to FIG. 6 of the drawings, an elongated ovaloid shape of the mold 12 is represented in its pure form.

FIG. 7 illustrates direct contoured features in which the sidewalls 15A and 15B are continuously contoured in a relationship to one another as indicated by broken lines 15CC and are therefore never parallel as illustrated by the oppositely disposed parallel indicator lines PL and are as illustrated less than 90 degrees from the horizontal.

Referring to FIG. 8 of the drawings which is a graphic section on lines 8-8 of FIG. 6, the contoured surface relationship can be seen in the end walls 16A and 16B which are contingently contoured in relation to one another as indicated by broken lines 16CC and as noted are therefore never in parallel relationship as indicated by end parallel line EPL.

It will be evident from the above description that the ice cube 13 so formed therewithin requires no ancillary tray distortion flexation as is required in prior art trays to dislodge the cubes by loosening from therewithin.

Given the nature of the holding and positioning flange surface 19, the bottom of each cube 13 so formed will have the corresponding notch in the cube, but given the directional orientation of the surface 19 extraction of the cube by the user tactile engagement will be effective only at corresponding cube end noted at 26 as illustrated in FIG. 5 of the drawings.

By utilizing the distinctive and unique mold surface orientation hereinbefore described of the ice cube tray of the invention, it will be seen that the known expansion properties of water as it freezes in which a physical force is imparted equilaterally to all contact surfaces. Therefore by eliminating all binding angular adjacent engagement surfaces in the interior of the mold 12 allows for the uniform expansion of the water within as it freezes maintaining a non-compliant formed cube 13 to the mold surface interaction. This allows for ease of longitudinal rotation of individual extraction of the so-formed cubes by force being applied to the formed contact upper surface 24 of the cube by user one end thereof as seen in FIG. 5 of the drawings.

Figure 2:
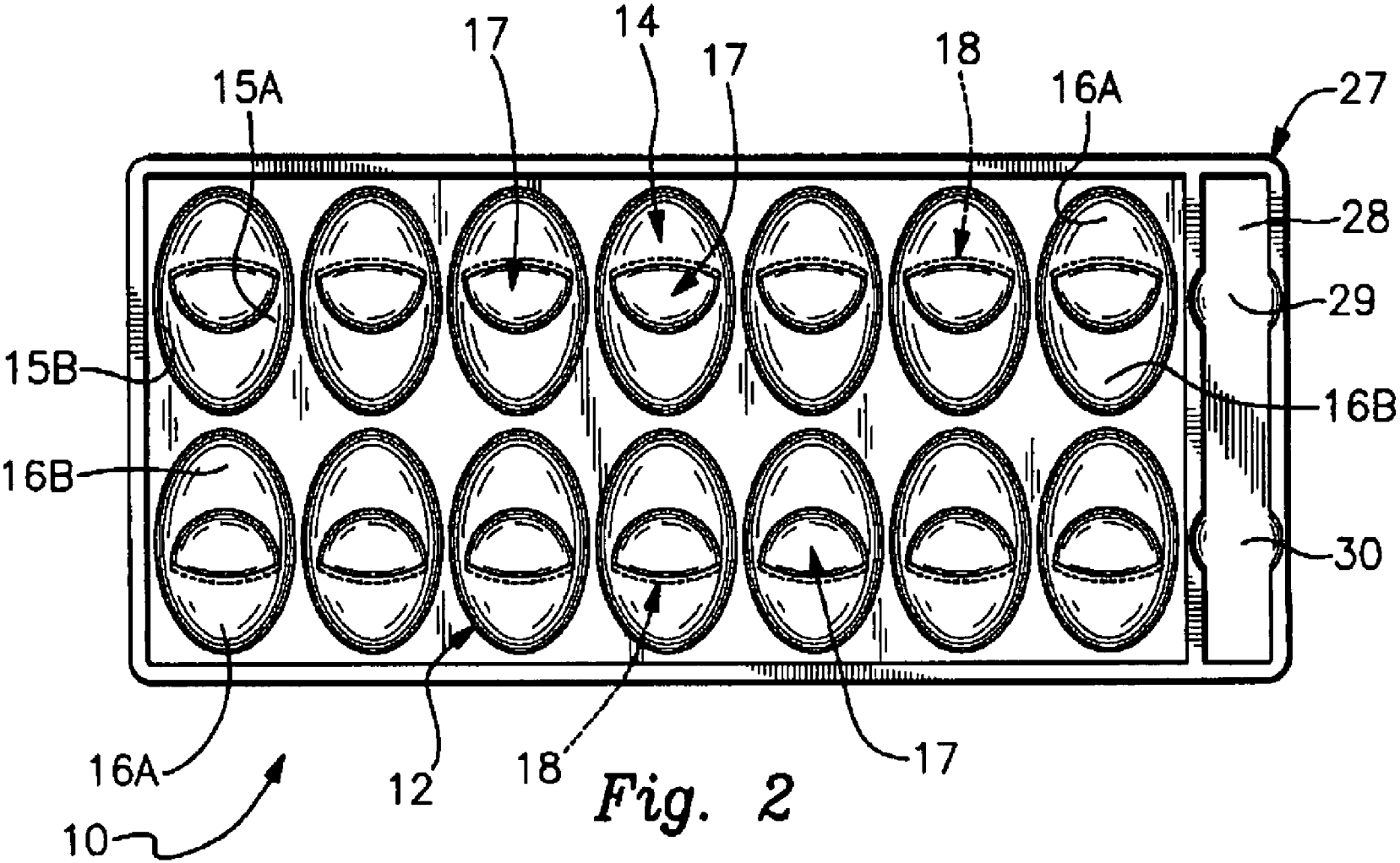
FIG. 2 is a top plan view of a complete ice cube tray of the invention.
Figure 3:
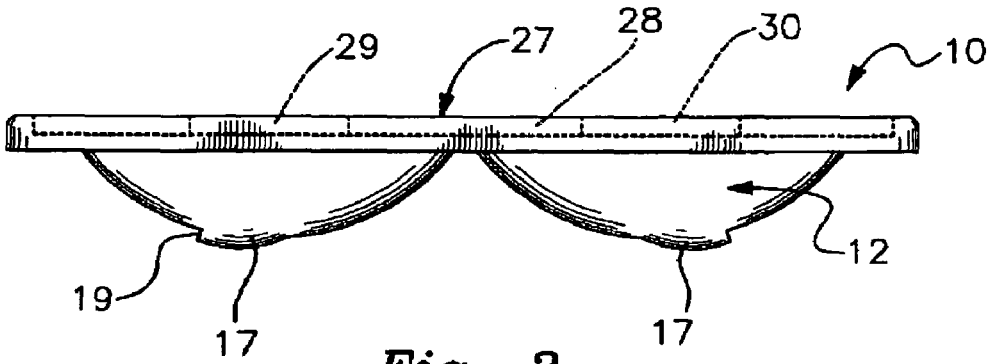
FIG. 3 is an enlarged cross-sectional view on lines 3-3 of FIG. 1.
Figure 4:
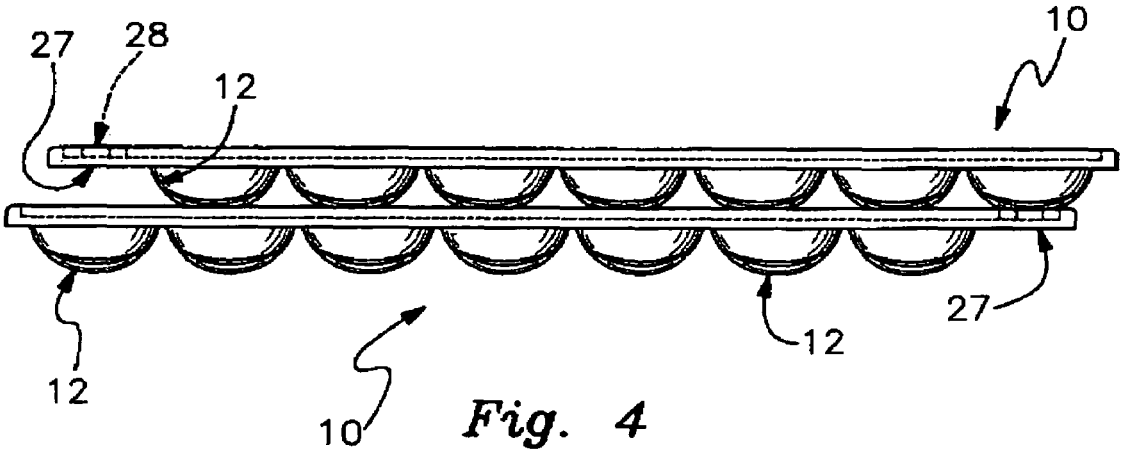
FIG. 4 is a side elevational view of the stackable tray.

Referring to FIGS. 1, 2 and 4 of the drawings, the ice cube tray 10 has an extended end flange portion 27 having a contoured secondary tray receiving recess area at 28 therewithin. The recess area 28 is generally rectangular with two longitudinally spaced area of increased transverse dimension at 29 and 30 respectively. The so-defined areas 29 and 30 correspond to spacing of the trans-adjacent mold cavities 12 bottom surface for registering receiving therewith when stacked vertically in alternating end to end relationship of identical tray configurations as illustrated in FIG. 4 of the drawings.

This orientation stacking allows the trays 10 to be stacked vertically during use in a freezer, not shown. It will thus be seen that a new and stackable individual ice cube extractor position element tray configuration has been illustrated and described and it will be apparent to those skilled in the art that various changes and modifications may be made thereto without departing from the spirit of the invention. Therefore

I claim:

1. An ice cube stacking tray of synthetic resin material having a plurality of individual spaced apart ice cube forming cavities, each of said cavities defining a contoured inner bottom surface with integrally extending co-contoured oppositely disposed respective angular side and end surface walls defining an ovaloid trans-planar interior concave surface, an elliptical recessed area within said inner bottom surface with a trans-arcuate depending vertical surface defined thereby, said elliptical recessed area having an angular ascending surface from said flange portion to said contoured inner bottom surface, an end flange extension having contoured recessed area for stacking said trays.

2. The ice cube stacking tray set forth in claim 1 wherein said integral contoured side and end surface walls are in co-angular orientation to one another.

3. The ice cube stacking tray set forth in claim 1 wherein said depending vertical surface is positioned midway along the longitudinal length of said ovaloid bottom surface.

4. The ice cube stacking tray set forth in claim 1 wherein an ice cube of frozen water formed within said respective cavities of said ice cube tray has a raised bottom area corresponding to said elliptical recessed area in said contoured inner bottom surface.

5. The ice cube stacking tray set forth in claim 1 wherein said end flange extension contoured recessed area for tray receiving comprises, longitudinally spaced areas of increased transverse dimension, said longitudinal spacing corresponding to spacing of said cube forming cavities.

6. The ice cube stacking tray set forth in claim 4 wherein said ice cube so molded within said cavity is supported for trans-lateral displacement under force application to said ice cube at one end thereof.

7. The ice cube stacking tray set forth in claim 4 wherein partial displacement of said ice cube from within said cavity by vertical force application provides for edge cube engagement with said vertical surface of said elliptical recessed areas self-supporting said cube in elongated exposed manner above the planar surface of said ice cube tray.

* * * * *